US005597112A

United States Patent [19]

Knapp

[11] Patent Number: 5,597,112

[45] Date of Patent: Jan. 28, 1997

[54] COLLAPSIBLE OCTAHEDRAL CONTAINER

[76] Inventor: Frederick W. Knapp, 23 Otis Pl., Verona, N.J. 07044

[21] Appl. No.: 322,925

[22] Filed: Oct. 13, 1994

[51] Int. Cl.[6] ..... B65D 5/02

[52] U.S. Cl. ..... 229/116; D9/430; D9/431; 229/109; 229/116.1; 229/149

[58] Field of Search ..... 229/109, 110, 229/116, 116.1, 149, 150, 158; 206/806; D9/430, 431

[56] References Cited

U.S. PATENT DOCUMENTS

| | | | |
|---|---|---|---|
| D. 178,925 | 10/1956 | March | D9/430 |
| 204,441 | 6/1878 | Marshall | 229/116 |
| D. 249,240 | 9/1978 | Klitzner | D9/231 |
| D. 317,262 | 6/1991 | Bluff | D9/431 |
| 781,082 | 1/1905 | Morris | 229/116 |
| 1,650,337 | 11/1927 | Fletcher . | |
| 2,050,894 | 8/1936 | Paige | 229/8 |
| 2,067,998 | 1/1937 | Williamson | 229/8 |
| 2,935,238 | 5/1960 | Koehler | 229/116 |
| 2,936,939 | 5/1960 | Lundquist | 229/8 |
| 3,079,062 | 2/1973 | Craddock et al. | 229/116 |
| 3,185,378 | 5/1965 | Rosenburg, Jr. | 229/150 |
| 3,666,607 | 5/1972 | Weissman | 229/116 |
| 3,668,796 | 6/1972 | Patterson | 229/8 |
| 3,885,266 | 5/1975 | Nafziger | 229/149 |
| 4,020,947 | 5/1977 | Roccaforte | 206/806 |
| 4,063,679 | 12/1977 | Henry | 229/116 |
| 4,230,259 | 10/1980 | Herzog | 206/806 |
| 4,260,097 | 11/1981 | Nold | 229/8 |
| 4,798,747 | 1/1989 | Laramee | 229/116 |
| 5,125,565 | 6/1992 | Rogers | 229/150 |

FOREIGN PATENT DOCUMENTS

| | | | |
|---|---|---|---|
| 1137479 | 5/1957 | France | 229/8 |
| 2237809 | 2/1975 | France | 229/116 |
| 2538215 | 4/1976 | Germany | 229/150 |
| 671810 | 10/1964 | Italy | 229/116 |
| 403993 | 1/1934 | United Kingdom | 229/116 |
| 519577 | 4/1940 | United Kingdom | 229/8 |
| 1217154 | 12/1970 | United Kingdom | 229/8 |
| 2235921 | 3/1991 | United Kingdom | 229/116 |

*Primary Examiner*—Gary E. Elkins
*Attorney, Agent, or Firm*—Michael Best & Friedrich

[57] ABSTRACT

The present invention relates to an octahedral container made from a thin flexible sheet which has six substantially triangular shaped side panels fastened together with an affixation tab, and three substantially triangular top and bottom panels which are provided with top tabs that slip into corresponding slots positioned along a top fold line located between the top and side panels and bottom tabs that slip into corresponding slots positioned along a bottom fold line located between the bottom and side panels. The container is further provided with two fold lines which each traverse a top, bottom and side panel so that the container can be shipped flat and then readily popped open and assembled at the point of usage.

12 Claims, 5 Drawing Sheets

COLLAPSIBLE OCTAHEDRAL CONTAINER

FIELD OF THE INVENTION

The present invention relates to the area of collapsible containers, and more particularly those which are octahedral in shape. The shape of the container can be easily adjusted in width and height to accommodate articles of all shapes and sizes. Moreover, the container in its unassembled form can be preglued along a side tab and provided with lateral side folds so that it may be easily shipped flat, and then popped up for easy assembly at the point of use. Further, the bottom may be specially configured with a v-shaped slot and small triangular panel with tabs placed on a wide v-shaped angle so that the user does not need any special instruction as to where the tabs go and the container shape pops up from shipped form which is a flattened shape.

SUMMARY OF THE INVENTION

The invention consists of a collapsible octahedral container made from a thin, flexible sheet of rigid or semi-rigid material which contains cut lines and fold lines. The fold lines are used both to collapse the container and to provide the octahedral shape and form when the container is fully assembled. The material which is used for the thin flexible sheet may be cardboard, paperboard, construction paper or even plastics and other polymeric compositions. The thin, flexible sheet may be either a solid color or a decorative image so that the container may be used as an ornament itself. The container may be made especially attractive when made from clear or tinted plastics, and crumpled tissue and confetti may be inserted around a gift.

The container consists of six triangular side panels which lie adjacent to one another and which are separated by fold lines. The opposing free edges of these adjacent lying panels may be further equipped with a glue tab which may affix the free edges together. After the opposing free edges of the six side panels have been secured, the container may be flattened for convenient shipping, but in a pre-assembled shape. A top and bottom panel lie on opposing sides of the six triangular side panels and separated by the six side panel portions by means of two fold lines. The top and bottom panels may be very simply secured to form an octahedral shape by providing four additional slot tabs each having slots located in their fold lines. Or, quite ingeniously, the bottom panel assembly can be expedited by providing a specially shaped triangular bottom slot panel with a v-shaped slot and a corresponding shorted triangular bottom tab panel with two tabs specially adapted to fit the v-shaped slot. In this manner, the octahedral container is much more easily assembled and without any explicit instruction as to where the various tabs must be put to assemble the container.

OBJECTS OF THE INVENTION

It is therefore one primary object of the present invention to provide a collapsible decorative octahedral container which can be quickly and easily assembled so as to hold a wide variety of objects such as those that are flat, those that are round, square, or long and narrow, such as tubes and rolled posters.

It is another primary object of the present invention to provide an octahedral container which is constructed of a relatively inexpensive material such as cardboard, paperboard, constructions paper and the like, or even clear or tinted plastic or other polymeric substances, which can be easily cut, scored and glued so that the container can be readily popped up into shape and easily assembled by the user.

Another primary object of the present invention is to provide an octahedral collapsible container which has a tab with a hole through it at the end of one of the top flaps which is scored so that it pops up away from the container allowing a wire rack to be passed therethrough for display purposes in a retail setting.

And it is yet a further primary object of the present invention to provide an octahedral container which has a glue or affixing tab along one of its outer side edges which allows the container to be flattened in a contiguous shape so that the container can be propped up into position for easy assemblage at the point of usage.

And it is yet a further primary object of the present invention to provide a construction of the bottom panel portion with a specially shaped triangular panel containing a v-shaped slot and a squat triangular panel having two corresponding tabs, which allows the bottom of the container to be assembled in one easy step without further instruction as to where the tabs are placed.

These and other objects and advantages of the present invention can be readily derived from the following detailed description of the drawings taken in conjunction with the accompanying drawings present herein and should be considered as within the overall scope of the invention.

DETAILED DESCRIPTION OF THE DRAWINGS

Figure 1:
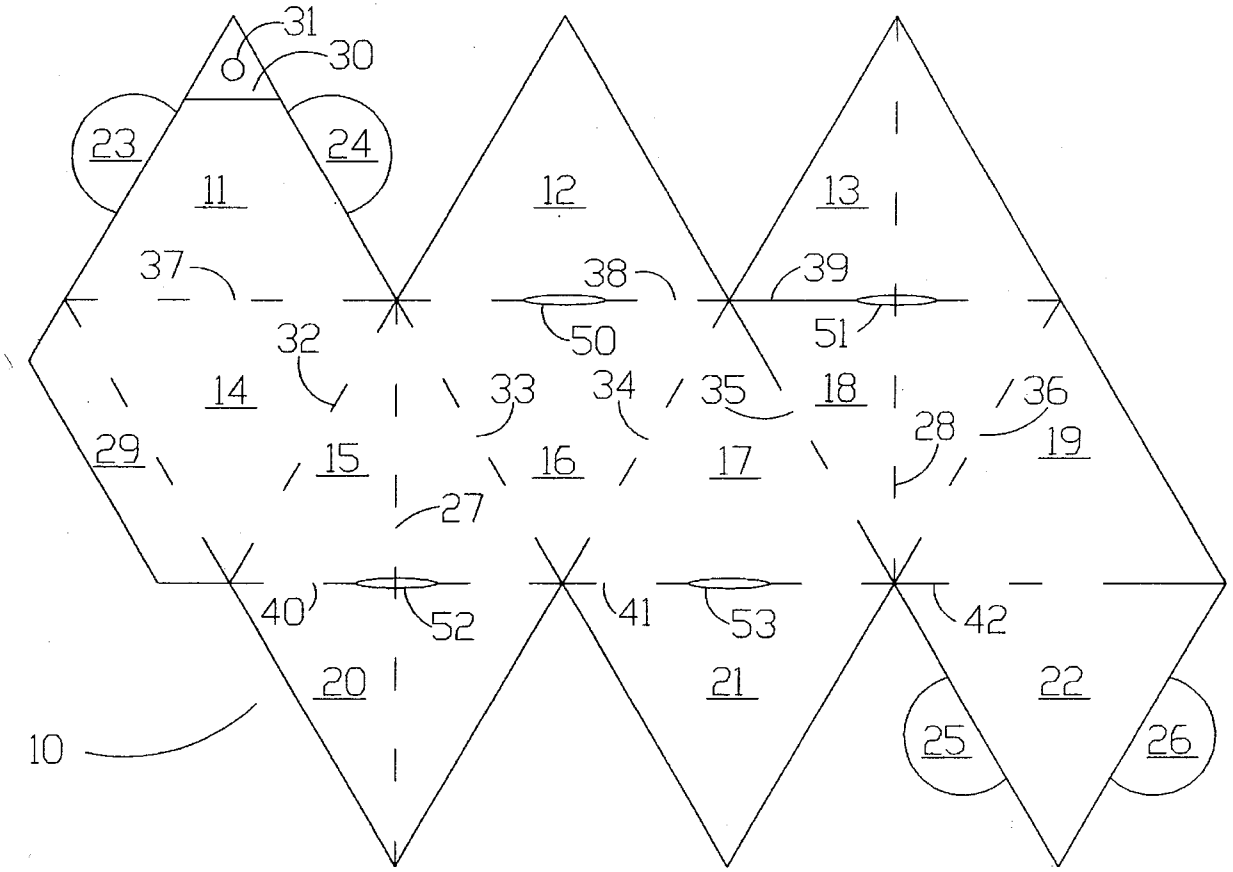
FIG. 1 is a top plan view of a cardboard blank for an equilateral shaped octahedral container is constructed.

FIG. 1 shows a cut or stamped blank 10 that is adapted to be folded into an octahedral shaped container. FIG. 1 consists of twelve equilateral shaped triangles, six of which are formed into one continuous row with score lines 32, 33, 34, 35 and 36 adjoining container sides 14, 15, 16, 17, 18 and 19. At the top, score lines 37, 38 and 39 join together sides 14, 16 and 18 to the container top sides 11, 12 and 13. Along the bottom of stamped blank 10, score lines 40, 41 and 42 join container bottom sides 20, 21 and 22 to sides 15, 17 and 19. Although one of the container top sides 11, 12 and 13 must be triangular in shape, two of the top panels, 12 and 13 may be of any shape, as long as they contain slots 50 and 51 in fold lines 38 and 39 which are adapted to receive tabs 23 and 24 of top panel 11. Likewise, although bottom panel 20 must be triangular in shape to complete close collapsible octahedral container 10, container bottom sides 20 and 21 may be of any configuration as long as slots 52 and 53 may be located along fold lines 40 and 42 which are adapted to receive tabs 25 and 26. Likewise tabs 23, 24, 25 and 26 may be made from a variety of configurations such as hexagonal, triangular, etc., or crescent shaped, as shown.

An affixation flap or glue flap 29 is joined to the edge of side 19 by either gluing the flap to the container side, or in the case of a plastic sheet, it may be affixed by heat fusion. Thus, depending upon the type of material used for the container, the appropriate method of affixation of the tab to the container side may be chosen. After the container side 19 has been joined to flap 29 in such a way, the usefulness of fold lines 27 and 28 becomes readily apparent because the container can be collapsed and shipped flat.

Figure 2:
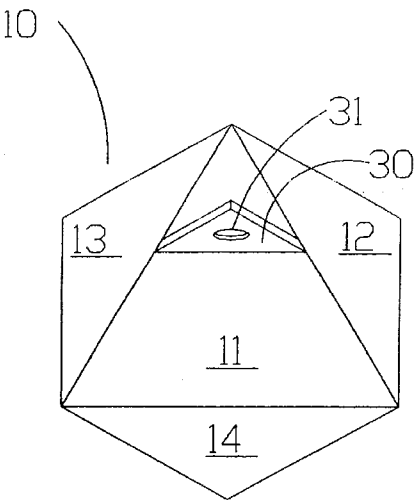
FIG. 2 is a top plan view of an equilateral octahedral shaped container.

FIG. 2 shows the particular configuration of the octahedral box when viewed from the top. In this view, small triangular flap 31 readily stands away from container 10 due to score line 30 and it is evident that hole 31 is placed in flap 30 so that a wire display rack, a tag or any other device for identifying or displaying the container can be easily slipped therethrough.

Figure 3:
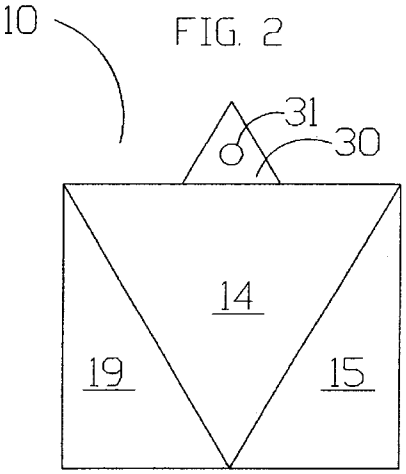
FIG. 3 is a front elevation view of an equilateral octahedral shaped container.

FIG. 3 shows a front view of stamped blank 10 fully assembled in which it should be noted that front side 14 is sloped toward the viewer, whereas equilateral triangles 19 and 15 appear distorted inasmuch as they are sloped away from the viewer.

Figure 4:
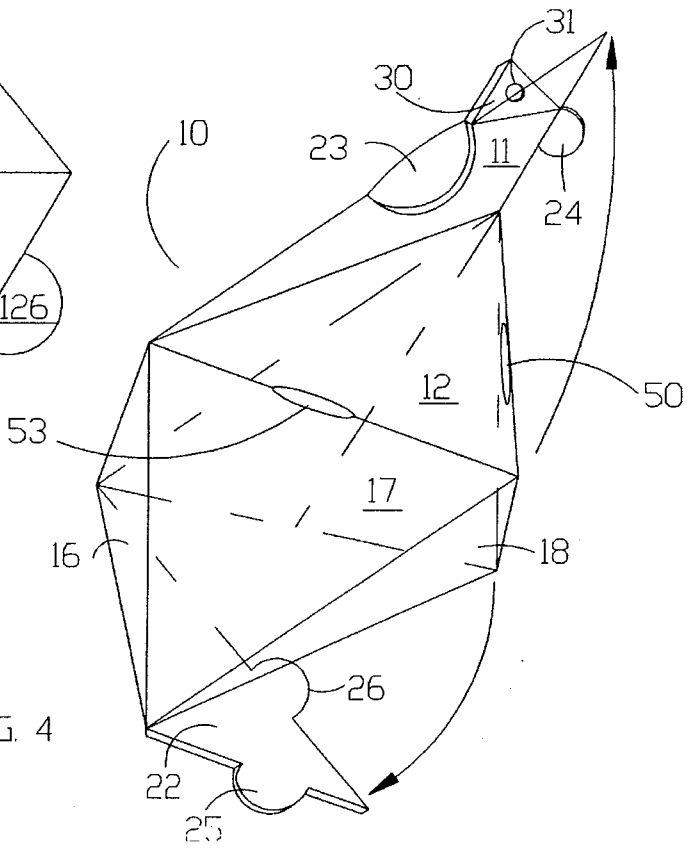
FIG. 4 is a top perspective view of an equilateral shaped octahedral container showing the container in its partially assembled form.

In FIG. 4, the assembled stamped blank or now container 10 is shown in its partially assembled view with flap 11 upstanding and flap 22 downstanding both ready to be assembled by tucking tabs 23, 24, 25 and 26 into slots 51, 52, 53 and 54. Affixation tab 29 has already been secured to side panel 19. Top flap 11 is shown upstanding in such a position where it is ready to have tabs 23 and 24 placed into slots 51 and 52, whereas bottom flap 22 is shown downstanding in such a position where it is ready to have its tabs 25 and 26 tucked into slots 52 and 53.

Figure 5:
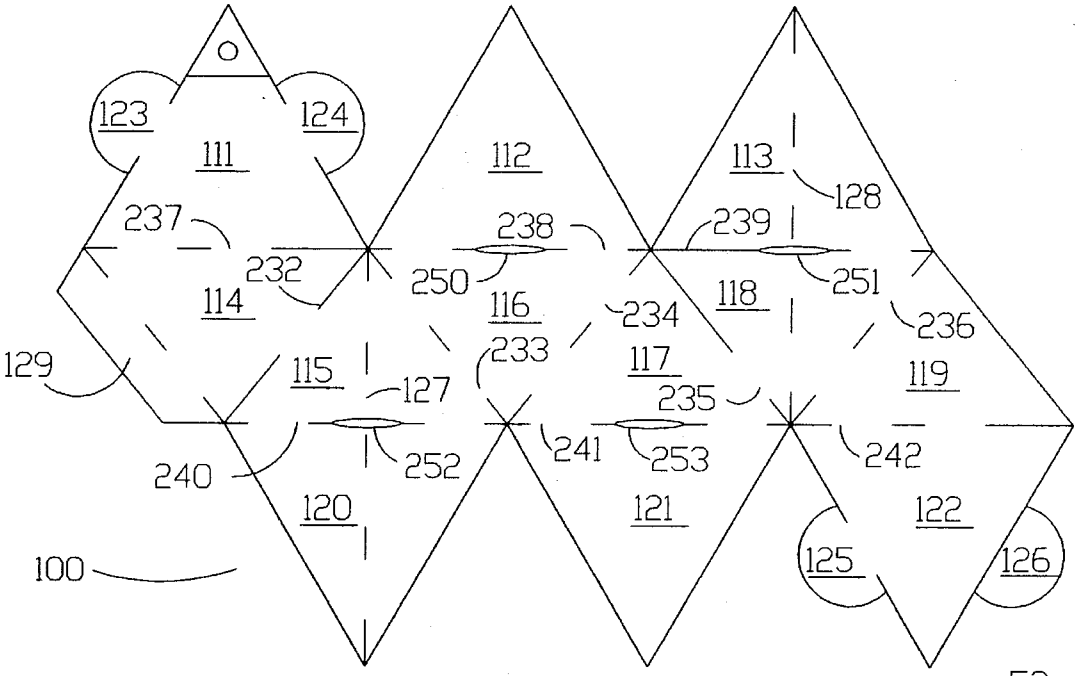
FIG. 5 is a top plan view of a cardboard blank for a squat shaped octahedral container.
Figure 6:
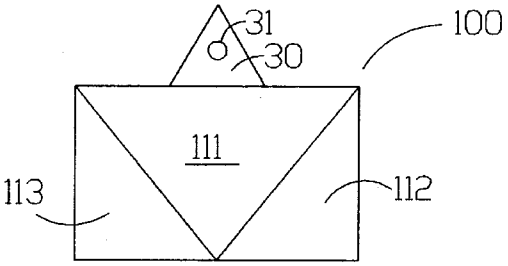
FIG. 6 is a elevation view of a cardboard blank for a squat shaped octahedral container.

FIG. 5 shows a squat version of the container 10 as container 100 in which top sides 111, 112, and 113 and bottom sides 120, 121 and 122 consists of equilateral triangles, whereas sides 114, 115, 116, 117, 118 and 119 consists of squat isosceles triangles. In this way, FIG. 6 demonstrates how when the container 100 is viewed from the front, it takes on a squat appearance which is perfect for flat articles such as jewelry, watches and the like. Again, fold lines 127 and 128 traverse both a side panel and a bottom or top panel, such that when affixation tab 129 is secured to side 119 the box can be folded flat for shipment and storage before assembly. It should be noted that when container 100 is viewed from the top it has the same appearance as container 10 shown in FIG. 2.

Figure 7:
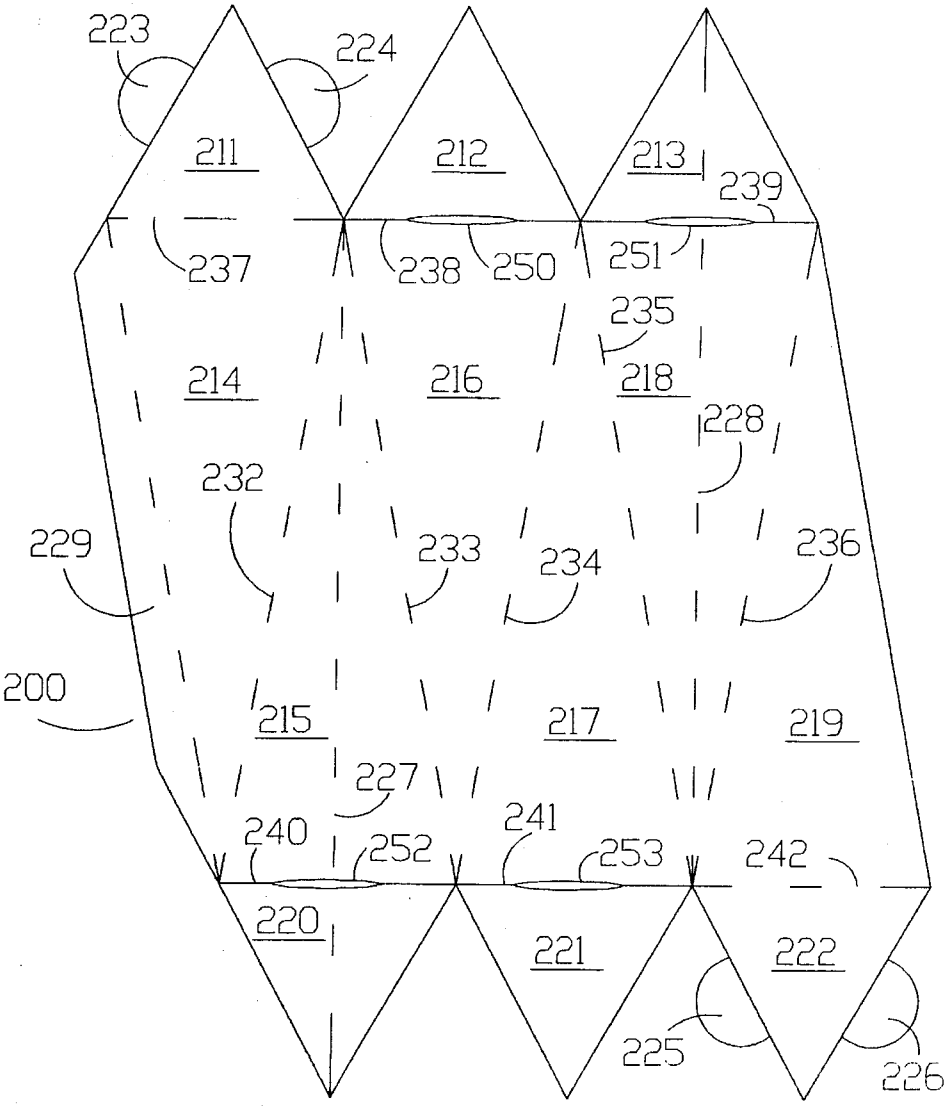
FIG. 7 is a top plan view of an elongated octahedral container.

FIG. 7 shows container 200 which is an elongated version of container 10, again with top sides 211,212 and 213 and bottom sides 220, 221 and 222 being equilateral in shape. However, side portions 214, 215, 216, 217, 218 and 219 are elongated in dimension, making the container readily capable of receiving tall objects such as rolled up posters, newspapers and the like. As noted above, fold lines 227 and 228 traverse both a side panel and a top or bottom panel such that when affixation tab 229 is secured to container side 219, container 200 can be folded flat for convenient shipment and storage.

Figure 8:
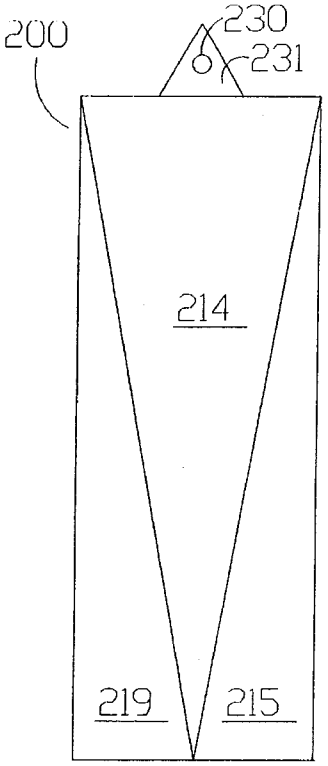
FIG. 8 is a front elevation view of an elongated shaped octahedral container.

FIG. 8 shows the front view of such elongated container 200 again with side 214 sloping from top to bottom toward the viewer, whereas sides 219 and 215, although equilateral in shape, are actually slanted away from the viewer. The top view of this container is the same as that shown for the equilateral container 10 of FIG. 2.

Figure 9:
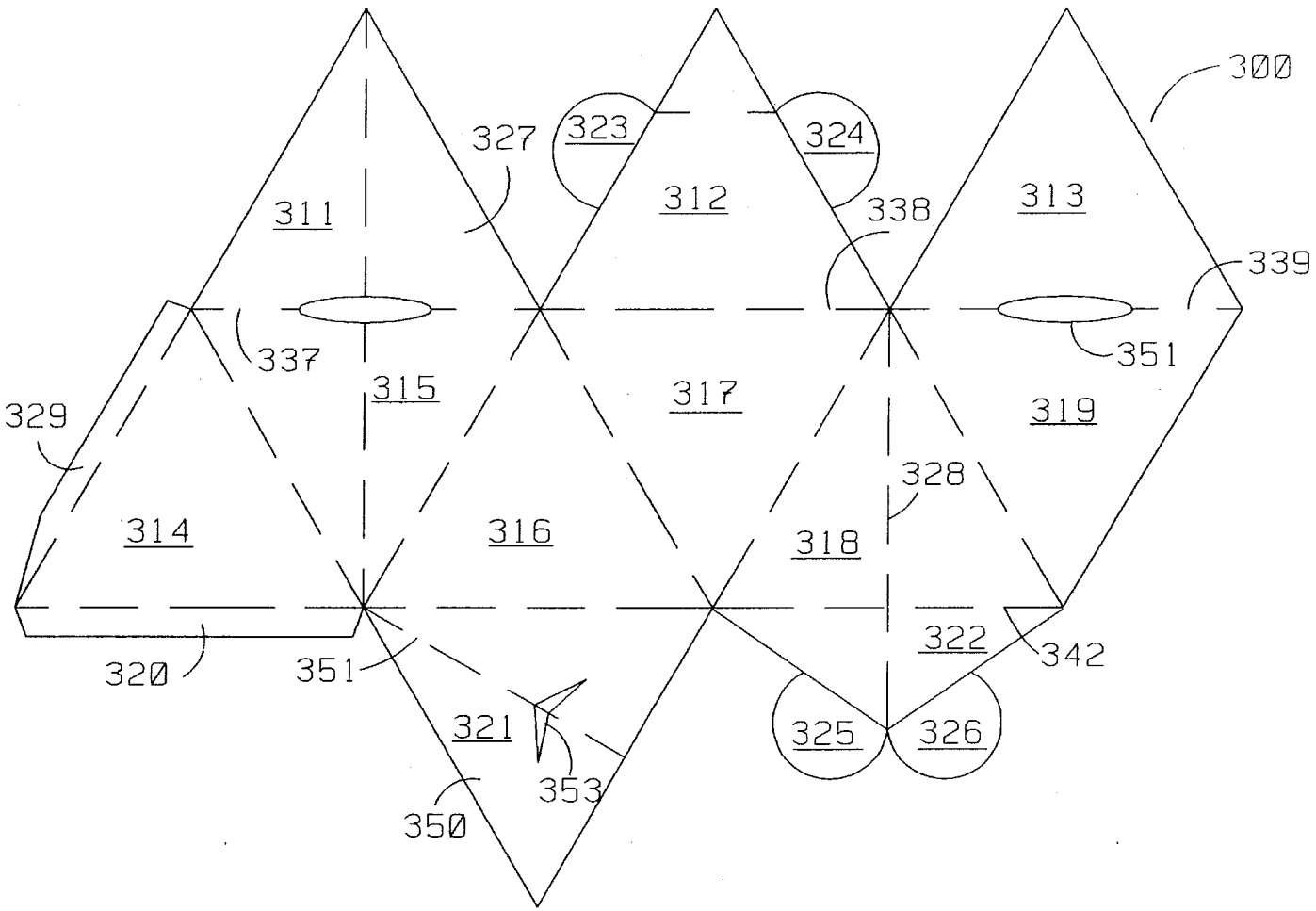
FIG. 9 is a top plan view of a cardboard blank for an equilateral octahedral container with an easy assembly bottom.

FIG. 9 shows collapsible octahedral container 300 with an easy to assemble bottom. Side panels 315 and 318 have longitudinal fold lines 327 and 328 which allows the collapsible octahedral container 300 to be folded flat for easy storage and shipment. A side glue affixation tab 329 is provided to secure the side edge of panel 314 to the side edge of panel 319. The bottom of the collapsible octahedral container 300 may be easily assembled because glue affixation tab 320 is already secured to free edge 350 of v-slot triangular panel 321. An additional longitudinal fold line 351 is provided on v-slot triangular panel 321 so that the collapsible octahedral container 300 may be folded flat for easy storage and shipment.

Figure 10:
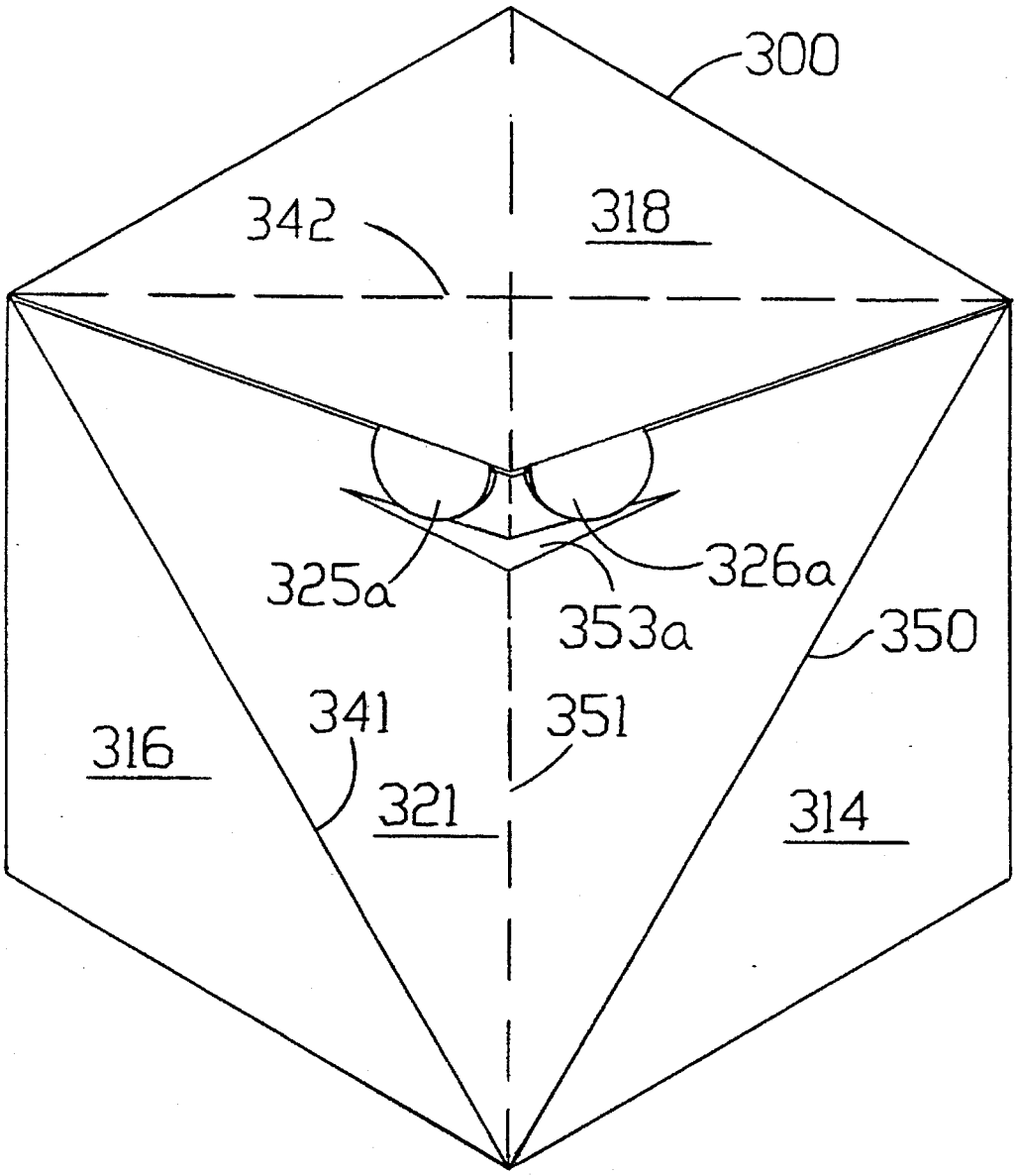
FIG. 10 is a bottom perspective view of an equilateral octahedral container showing the bottom portion as it is being assembled.

FIG. 10 shows collapsible octahedral container 300 in a perspective view slightly tipped up and away from the viewer so that the details of assembling bottom panel 321 are readily apparent. Side panel 318 has been pushed down so that tabs 325 and 326 are ready to be inserted into v-shaped slot 353 easily forming the bottom of collapsible octahedral container 300. In this manner, as collapsible octahedral container 300 is moved from its flat shipping/storage form into its assembled form, the user will have no trouble and will not need any instruction in order to construct the bottom of the container because as the collapsible octahedral container 300 is pushed from a flat form into a three-dimensional form, side panel 318 affixed to double tabs 325 and 326 are automatically pushed in close proximity to v-shaped slot 353, allowing for easy insertion thereof.

Although in the foregoing detailed description the present invention has been described by reference to various specific embodiments, it is to be understood that modifications and alterations in the structure and arrangement of those embodiments other than those specifically set forth herein may be achieved by those skilled in the art and that such modifications and alterations are to be considered as within the overall scope of this invention.

What is claimed is:

1. A blank for forming a collapsible octahedral structure comprising;

a sheet having six adjacent triangular side panels with five side fold lines therebetween and at least two longitudinal fold lines traversing at least two of the six adjacent triangular side panels, at least one triangular top panel, and at least one triangular bottom panel;

at least one top fold line lying between the top panel and the side panels; and at least one bottom fold line lying between the bottom panel and the side panels wherein when the blank is folded along its longitudinal fold lines it may be stored in a compact flattened form, and when it is folded along each of the side panel fold lines and the top and bottom fold lines, it creates an octahedral three dimensional structure.

2. The device according to claim 1 further having;

an affixation tab extending from one of the triangular side panels which may be used to secure the six adjacent side panels together by applying a thin coat of adhesive thereto.

3. The device according to claim 1 further having;

two top slot tabs with fold lines extending from two side panels and having slots positioned in each fold line; and, two bottom slot tabs with fold lines extending from two side panels and having slots positioned in each fold line.

4. The device according to claim 1 where the two triangular side panels which lie adjacent only one fold line are triangular end panels and the device further has;

affixation means which secures both of the triangular end panels together so that the device may be stored flat and then more easily assembled into a three dimensional octahedral structure when it is folded along each of the side panel fold lines and the top and bottom fold lines.

5. The device according to claim 4 where the affixation means consists of a tab extending from one of the triangular end panels which may be secured to the other triangular end panel by applying a coating of an adhesive therebetween.

6. The device according to claim 1 wherein the top panel further has affixation means for securing it to two adjacent side panels; and the bottom panel further has affixation means for securing it to two adjacent side panels.

7. A blank for forming a collapsible octahedral structure comprising;

a sheet having six adjacent triangular side panels with five side fold lines therebetween, at least one top triangular panel with securement means for securing it to two of the adjacent side panels;

at least one bottom triangular panel with securement means for securing it to two of the adjacent side panels;

at least one top fold line lying between the top panel and the side panels; and at least one bottom fold line lying between the bottom panel and the side panels wherein when the blank is folded along its longitudinal fold lines it may be stored in a compact flattened form, and when it is folded along each of the side panel fold lines and the top and bottom fold lines, it creates an octahedral three dimensional structure.

8. The device according to claim 7 further having;

at least one tab bottom slot and one tab top slot; and the securement means for both the top and bottom triangular panels comprises at least one tab;

wherein when the top tabs are positioned in their corresponding slots and the bottom tabs are positioned in their corresponding slots, an octahedral structure is formed.

9. The device according to claim 8 wherein;

two of the adjacent side panels are provided with longitudinal fold lines so that the blank may be stored in a compact, flat form.

10. The device according to claim 8 further having at least one additional top and bottom panel where the tab top slot lies in a fold line between a top panel and an adjacent side panel and the bottom top slot lies in a fold line between a bottom panel and an adjacent side panel.

11. The device according to claim 8 further having at least one additional top and bottom panel where the tab top slot lies in a fold line between a top panel and an adjacent side panel and the tab bottom slot lies in the triangular bottom panel.

12. The device according to claim 11 where the securement means for the bottom triangular panel comprises two tabs and the bottom slot is v-shaped in configuration.

* * * * *